US009975614B2

(12) United States Patent
Minecci

(10) Patent No.: US 9,975,614 B2
(45) Date of Patent: May 22, 2018

(54) PERSON-IN-THE-WATER RESCUE AND RETRIEVAL SYSTEM

(71) Applicant: Paul C. Minecci, Plymouth Meeting, PA (US)

(72) Inventor: Paul C. Minecci, Plymouth Meeting, PA (US)

( * ) Notice: Subject to any disclaimer, the term of this patent is extended or adjusted under 35 U.S.C. 154(b) by 3 days.

(21) Appl. No.: 15/226,629

(22) Filed: Aug. 2, 2016

(65) Prior Publication Data

US 2016/0340008 A1 Nov. 24, 2016

Related U.S. Application Data

(63) Continuation-in-part of application No. 14/459,471, filed on Aug. 14, 2014, now Pat. No. 9,415,847.

(51) Int. Cl.
*B63C 9/26* (2006.01)
*B63C 9/22* (2006.01)

(52) U.S. Cl.
CPC ..... *B63C 9/26* (2013.01); *B63C 9/22* (2013.01); *B63C 2009/265* (2013.01)

(58) Field of Classification Search
CPC .... B63C 9/00; B63C 9/01; B63C 9/22; B63C 9/26; B63C 2009/265
USPC ..... 441/80–85
See application file for complete search history.

(56) References Cited

U.S. PATENT DOCUMENTS

| | | | | |
|---|---|---|---|---|
| 4,799,906 | A * | 1/1989 | Perkins, Jr. | B63C 9/22 102/504 |
| 4,912,869 | A * | 4/1990 | Govett | F41C 7/00 42/105 |
| 5,326,101 | A * | 7/1994 | Fay | F41B 11/57 124/1 |
| RE36,965 | E * | 11/2000 | Salvemini | B63C 9/26 441/85 |
| 9,056,661 | B2 * | 6/2015 | Macri | B63C 9/22 |
| 9,415,847 | B2 * | 8/2016 | Minecci | B63C 9/26 |
| 2002/0134365 | A1 * | 9/2002 | Gray | F41H 13/0006 124/56 |
| 2014/0331984 | A1 * | 11/2014 | Brahler, II | F41B 11/723 124/76 |

* cited by examiner

*Primary Examiner* — Ajay Vasudeva
(74) *Attorney, Agent, or Firm* — Dale J. Ream

(57) ABSTRACT

A person-in-the-water rescue and retrieval system includes a net assembly having a pair of laterally spaced apart side ropes and a plurality of net portions, each net portion being constructed of a material that floats, extends laterally between the side ropes, and is spaced apart longitudinally from an adjacent net portion. The system includes a deployment capsule defining an interior space configured to selectively receive the net assembly therein. A launching device includes a framework configured to receive the deployment member. A first compressed air canister is in fluid communication with the launching device and the deployment member and configured to apply force to the deployment member when actuated that is sufficient to propel the deployment member from the launching device. The launching device may be boat mounted or configured as a handheld device such as in the form of a rifle.

12 Claims, 17 Drawing Sheets

PERSON-IN-THE-WATER RESCUE AND RETRIEVAL SYSTEM

REFERENCE TO RELATED APPLICATIONS

This application claims the benefit of patent application U.S. Ser. No. 15/226,629 filed Aug. 2, 2016 titled Man-Overboard Rescue And Retrieval System, now U.S. Pat. No. 9,415,847 and which is incorporated herein by reference.

BACKGROUND OF THE INVENTION

This invention relates generally to safety devices and, more particularly, to a system for rescuing and retrieving a person who has fallen overboard from a boat or is unintentionally in the water otherwise in the water and that utilizes a launching device for propelling a net assembly to spread over an area of water where the person overboard is located.

Unfortunately, a person who falls overboard from a boat or ship often succumbs to drowning or frigid conditions before he can be rescued. There are five (5) steps to successfully recovering someone who has gone overboard: (1) Getting floatation to the victim (2) Locating and keeping the victim in sight; (3) Returning to the victim in order to render aid, (4) Connecting the victim to the boat; and (5) Recovering the victim into the boat. Unfortunately, more than half of all persons who fall overboard are not recovered alive. The biggest problem with making such a rescue is locating the victim and returning the boat in time to rescue the person. Unfortunately, the time required to attempt a rescue often takes more time than a victim has, thus ending in tragedy. Similarly, it can require significant time to rescue persons who get caught in rip currents or fall through ice, which can also lead to tragedy.

Various products have been proposed in the prior art to improve the ability and results of attempting to rescue and recover a victim who has fallen overboard from a boat. Although assumably effective for their intended purposes, the existing products and proposals do not provide a net assembly or a method of delivery that is likely to improve the chances of successfully rescuing and retrieving a person who has fallen overboard. For instance, a flotation device only covers the specific area of the float—so it only saves the victim if it can be positioned directly with the victim. Similarly, a rope (with or without a flotation device) is a line in the water, covering only the length of the rope and only in one direction or dimension. Further, traditional rescue devices can only rescue a single victim at a time, making for difficult decisions by first responders regarding which victim to rescue if there are multiple victims in the water.

Therefore, it would be desirable to have a person-in-the-water rescue and recovery system that provides a net assembly that can blanket a large area in which a person-in-the-water victim (or victims) is likely to be recovered. Further, it would be desirable to have a person-in-the-water rescue and recovery system that provides a launching device for propelling the net assembly into the immediate vicinity of the person-in-the-water victim. In addition, it would be desirable to have a floating net assembly that includes inflatable net spreader members that keep the net assembly from tangling or shrinking in size once in the water. Still further, it would be desirable to have a net assembly that includes net portions spaced apart so as not to cover up the victim to be rescued.

SUMMARY OF THE INVENTION

A person-in-the-water rescue and retrieval system according to the present invention includes a net assembly having a pair of laterally spaced apart side ropes and a plurality of net portions, each net portion extending laterally between the side ropes and being spaced apart longitudinally from an adjacent net portion. The system includes a deployment capsule operatively defining an interior space configured to selectively receive the net assembly therein prior to deployment. A launching device includes a framework configured to receive the deployment member. A first compressed air canister is in fluid communication with the launching device and the deployment member is configured to apply force to the deployment member when actuated that is sufficient to propel the deployment member from the launching device, one end of the net being coupled to the boat such that the net can be reeled back in to make a rescue. Each net portion includes a net spreader connected to a second compressed air canister for selective inflation thereof so as to spread apart the side ropes and net portions.

In an embodiment, the launching device for deploying the net assembly into the water behind a boat may include a handheld framework in the form of a rifle. In other words, a user may hold launching device against his shoulder and by hanging onto to a support handle—launching the net assembly over the water with the simple pull of a trigger. The launching device may include a housing coupled to the handheld framework that includes a housing configured to contain a net assembly packed therein or wrapped around a reel. A weighted, floating projectile is positioned on the forward/distal end of the handheld framework and in fluid communication with a propellant canister, an actuation of a burst of propellant, e.g. compressed air or gas, launching the projectile into the air and pulling the net assembly out of the housing and into the air.

In use, the net assembly is packed into the deployment member. When a person has fallen overboard and is in need of rescue, the launching device may be positioned in the direction of the victim. The deployment capsule is then propelled into the air with a burst of compressed air. As the deployment capsule extends away from the launching device, the net assembly is spread out and comes to rest on the water surface, one end of the net being coupled to the boat such that the net can be reeled back in later to make a rescue. The net spreader members are inflated by the flow of compressed air and are configured to keep side ropes of the net assembly urged outwardly so as to prevent the net portions from being bunched or tangled, thus expanding to its maximum coverage area.

Therefore, a general object of this invention is to provide a person-in-the-water rescue and recovery system having a net assembly that can be expeditiously launched behind a boat from which a person has gone overboard.

Another object of this invention is to provide a person-in-the-water rescue and recovery system, as aforesaid, in which the net assembly includes a plurality of net portions spaced apart longitudinally so as to be separated by areas void of netting.

Still another object of this invention is to provide a person-in-the-water rescue and recovery system, as aforesaid, in which each net portion of the net assembly includes an inflatable net spreader member configured to keep the net portion from becoming tangled or bunched up.

Yet another object of this invention is to provide a person-in-the-water rescue and recovery system, as aforesaid, in which the launching device utilizes high pressure compressed air to propel the deployment capsule into the air so that it reaches its maximum distance astern.

A further object of this invention is to provide a man-overboard rescue and recovery system, as aforesaid, that includes a length and width suitable to rescue multiple overboard persons simultaneously.

A still further object of this invention is to provide a person-in-the-water rescue and recovery system, as aforesaid, in which the launching device may be in the form of a boat mounted or handheld device.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
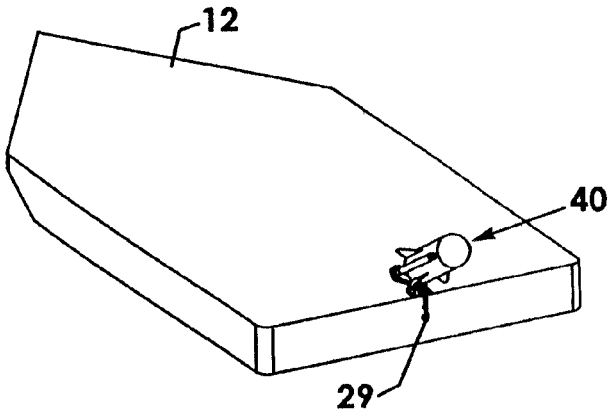
FIG. 1*a* is a perspective view of a person-in-the-water rescue and recovery system illustrating an un-deployed configuration.

A system for rescuing a person in the water who has fallen overboard from a boat according to a preferred embodiment of the present invention will now be described in detail with reference to FIGS. 1*a* to 14 of the accompanying drawings. The person-in-the-water rescue and recovery system 10 includes a net assembly 20, a deployment member 40, and a launching device 60 configured to receive the deployment capsule 42 and to selectively propel the deployment capsule 42 away from the launching device 60. When deployed, the net assembly 20 is spread out on the water's surface so that the person having fallen overboard may be pulled to safety.

The net assembly 20 includes several components that enable it to spread out effectively on a body of water, minimize it from becoming tangled, and to prevent it from contributing to the danger of drowning faced by the person who has fallen overboard. Specifically, the net assembly 20 includes a pair of side ropes 22 that constitute lateral borders of the net assembly 20. Preferably, each side rope 22 includes a first end 24 and an opposed second end 26, each side rope 22 having an elongate and generally linear configuration. When deployed, the side ropes 22 are substantially parallel to one another. Preferably, the netting rope is constructed of a material that floats, such as polypropylene. It is understood that the first ends 24 of the side ropes 22 are operatively coupled to the boat such that the net can be reeled back in later to make a rescue.

Figure 1B:
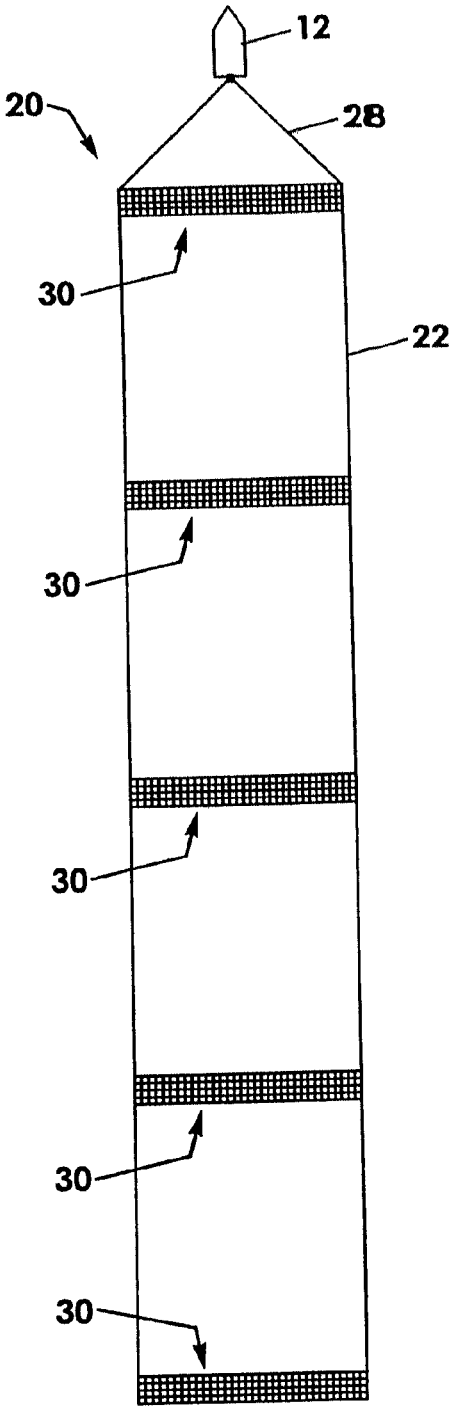
FIG. 1*b* is a perspective view of the rescue and recovery system as in FIG. 1*a* illustrating a deployed configuration.
Figure 2A:
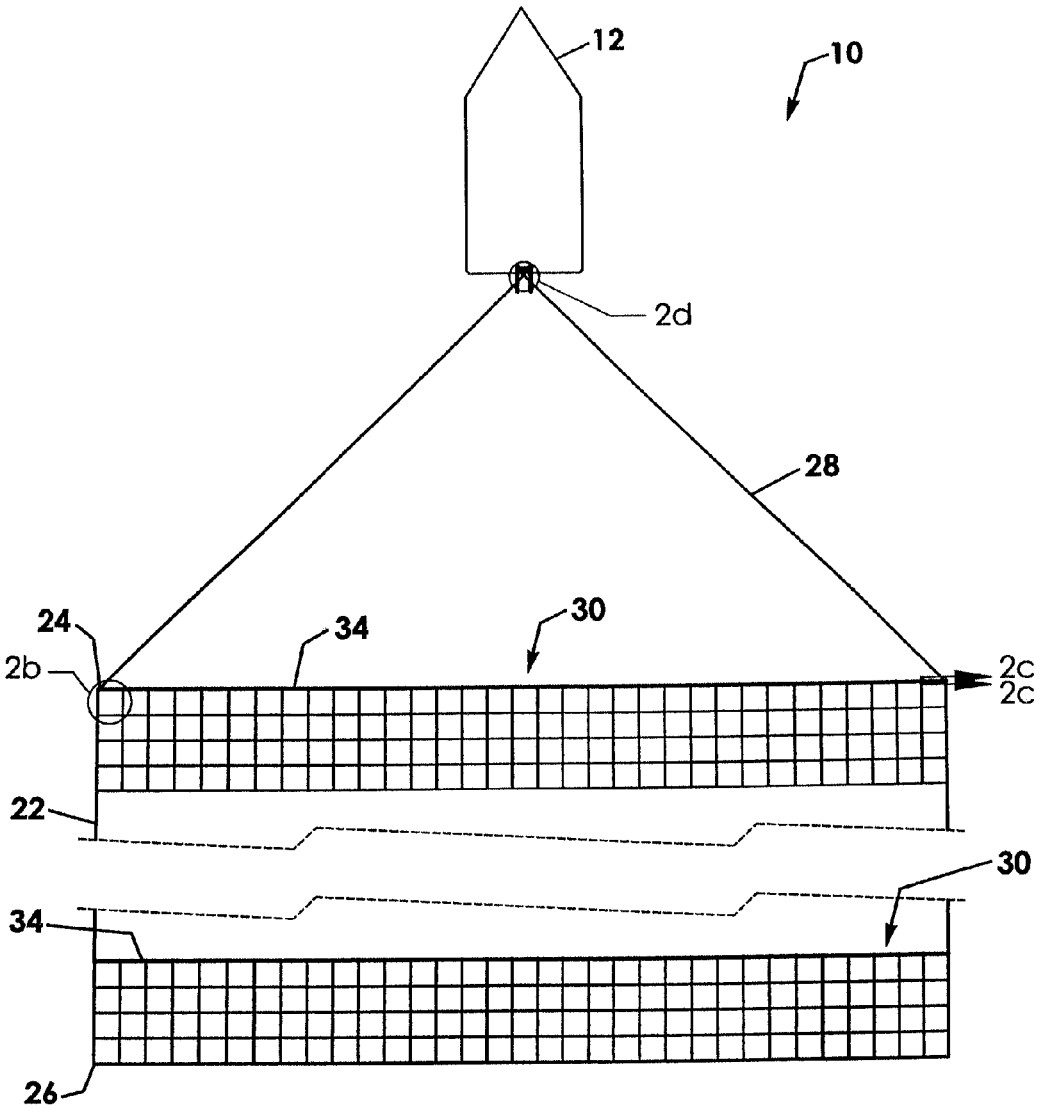
FIG. 2*a* is fragmentary perspective view on an enlarged scale of the rescue and recovery system as in FIG. 1*b;*
Figure 2B:
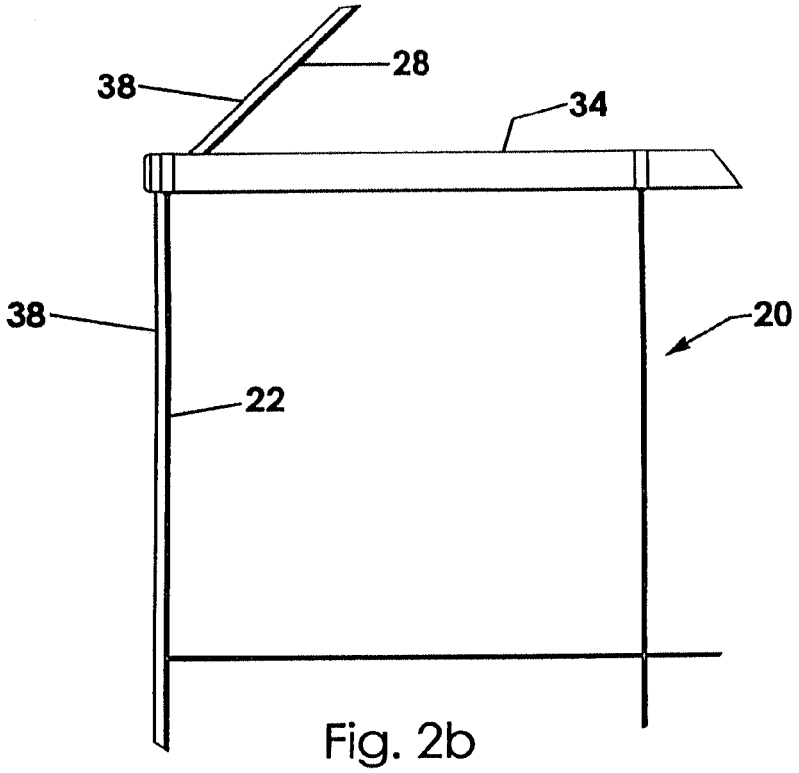
FIG. 2*b* is an isolated view on an enlarged scale taken from FIG. 2*a;*
Figure 2C:
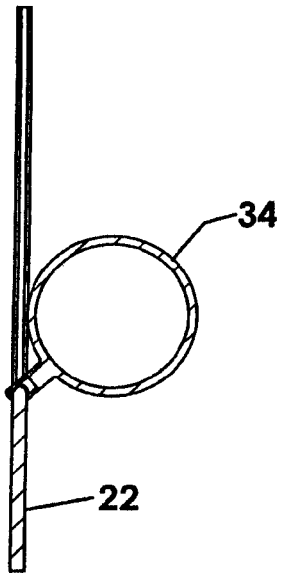
FIG. 2*c* is a sectional view taken along line 2*c*-2*c* of FIG. 2*a;*

Each one of the plurality of net portions 30 extends laterally between the opposed side ropes 22 (FIG. 2*a*). Each net portion 30 includes a lattice of netting. In an embodiment shown in FIG. 2*a*, a net portion 30 includes four (4) rows of net squares and 33 columns of net squares although variations of the number of net squares would also work. Each one of the plurality of net portions 30 are spaced apart longitudinally from a next adjacent net portion 30. In other words, the net assembly 20 defines a void 32 between each net portion 30 (FIG. 1*b*). Each void 32 presents a larger geometric area (i.e. square footage) than each adjacent net portion 30. It is critical that the geometric pattern of net portions and voids be this way so that a person overboard is not covered or pinned down by the netting while being rescued. In other words, a person being rescued has the ability to grasp a nearby net portion 30 while himself floating in a void 32 where there is no net portion 30. In addition, it is assumed that a boat deploying the net assembly 20 will still be moving forward so that a net portion 30 will intercept a person who is at first positioned in a larger void 32.

The net assembly 20 includes a plurality of net spreader members 34. One net spreader member 34 is associated with each net portion 30. A respective net spreader member 34 includes opposed ends, each opposed end being coupled to respective opposed side ropes 22 (FIG. 2*a*) such that the net spreader member 34 extends therebetween. In an embodiment, each net spreader member 34 has a flexible, resilient, and tubular configuration (FIG. 2*c*) that is movable between an inflated configuration that pushes outwardly against respective side ropes 22 and a substantially deflated configuration that allows the side ropes 22 to drift or move toward one another. A net spreader member 34 is coupled to a leading edge of a net portion 30 (FIG. 2*a*).

Each net spreader member 34 is in fluid communication with a compressed air canister 36, such as with a hose 38, such that a respective net spreader member 34 is inflated when the compressed air canister 36 is actuated to deliver high pressure compressed air to the net spread member 34. The hose 38 may be coupled to or situated adjacent to the opposed side ropes 22 (FIG. 2*b*), the compressed air canister 36 being situated remote from the net spreader member 34 that it inflates. The compressed air canister configured to selectively inflate the plurality of net spreader member 34 may also be referred to as a second compressed air canister 36.

In an embodiment, the second compressed air canister 36 is a single $CO_2$ canister in that such a canister provides a much larger volume of gas than a similar canister of air. This is contrasted with the preference to use a canister of air for launching the deployment member 40 in that compressed air provides superior pressure. Inflation of the plurality of net spreader members 34 may be initiated manually such as by an attendant responsible for actuating deployment or may be initiated automatically. In various embodiments, automatic deployment may be accomplished by a predetermined delay of activation of the second compressed air canister 36 so as to give the net assembly 20 time to be spread out on a water surface or may be as the result of moisture sensors that detect when the net spreader members 34 have made contact with the water.

In one embodiment, the deployment member 40 may be a deployment capsule 42. More particularly, the deployment capsule 42 includes a housing 44 having a continuous side wall 46, giving the housing 44 a generally cylindrical configuration and defining an interior space. The housing 44 may include a nose cone 48 at an upper end of the side wall 46 having a rounded or hemispherical configuration. A plurality of aerodynamic spaced apart fins 50 may be coupled to the side wall 46 and extend outwardly, the configuration of the side wall 46, nose cone 48, and fins 50 enhance flight of the deployment capsule 42 when propelled from the launching device 60.

Figure 6A:
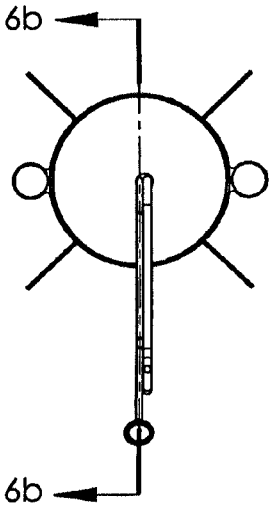
FIG. 6*a* is a rear view of the deployment capsule packed with the net assembly in an un-deployed configuration according to the present invention.
Figure 6B:
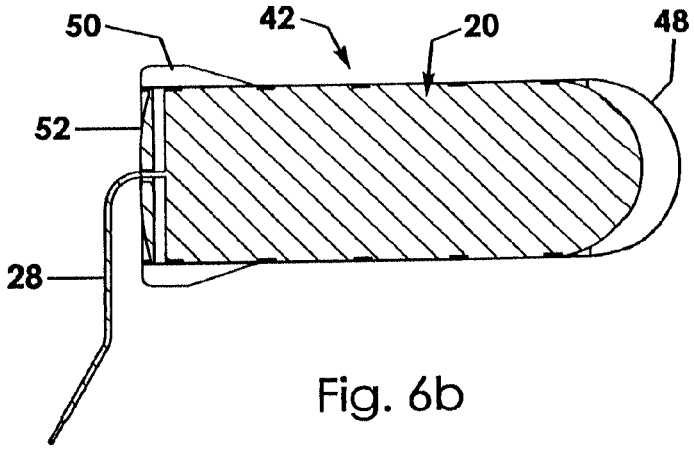
FIG. 6*b* is a sectional view taken along line 6*b*-6*b* of FIG. 6*a;*

The deployment member 40 is configured to receive the net assembly 20 therein, such as in a prepackaged state. Specifically, the net assembly 20 may be compressed into a relatively small volume of space when the plurality of net spreader members 34 is deflated. The net assembly 20 is packed into the interior space of the deployment capsule 42, such as at the point of manufacturing (FIG. 6*b*). The housing 44 defines an open lower end that is selectively covered by an end cap 52 in a manner that releases the net assembly 20 when the deployment capsule 42 is discharged and propelled away from the launching device 60. The end cap 52 defines an aperture 54 through which a mounting segment 28 of the first ends 24 of respective side ropes 22 extend as well as through which the hose 38 to the second compressed air canister 36 extends. The mounting segment 28 may be coupled to a net attachment ring 29, which in turn, may be coupled to a fixed object, such as a boat, to the launching device 60, or a mounting member. Therefore, when the deployment capsule 42 is propelled away from the launching device 60, the side ropes 22, being coupled to the attachment ring 29 are pulled out of the capsule 42 and the entire net assembly 20 is incrementally spread out over a water surface.

In an embodiment, the deployment member 40 may be a weight or projectile operatively coupled to respective first ends of the side ropes 22 (not shown). The projectile may be a javelin, a rocket, a drone, or the like. The projectile would be operatively coupled to the first ends 24 of respective side ropes 22, such as via the mounting segment 28, and spread the net assembly 20 out across a water surface when the projectile is propelled or launched from the launching device 60.

Figure 3A:
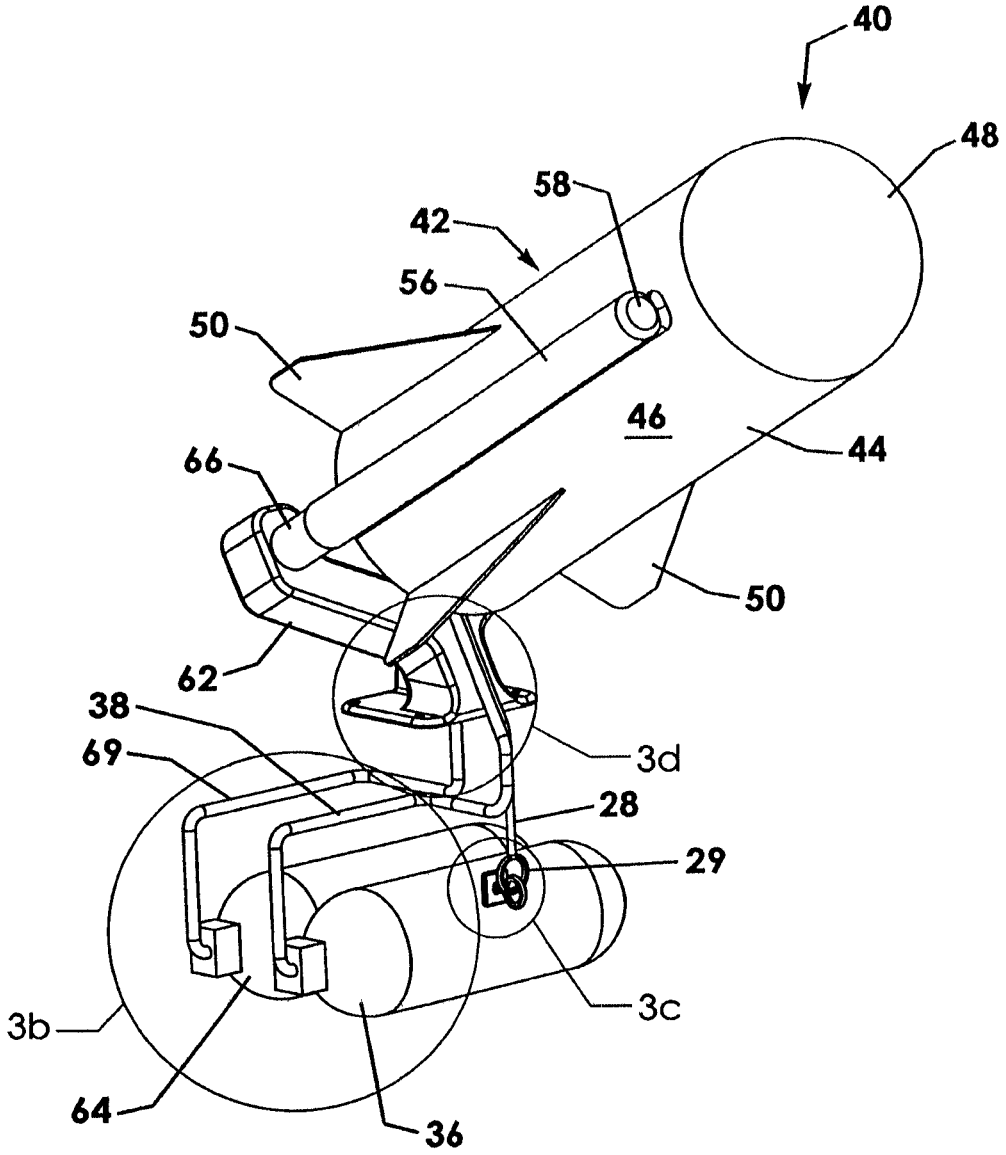
FIG. 3*a* is a perspective view of a launching device and deployment member according to the present invention.
Figure 3B:
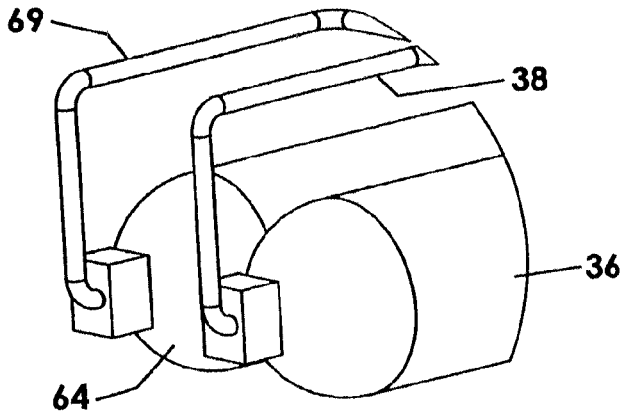
FIG. 3*b* is an isolated view on an enlarged scale taken from FIG. 3*a;*
Figure 3C:
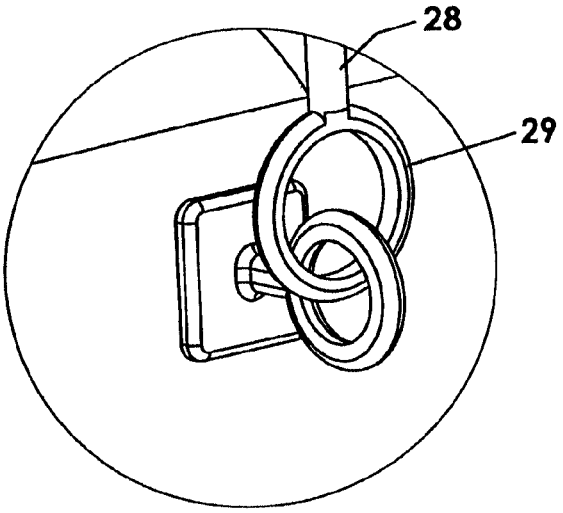
FIG. 3*c* is an isolated view on an enlarged scale taken from FIG. 3*a;*
Figure 3D:
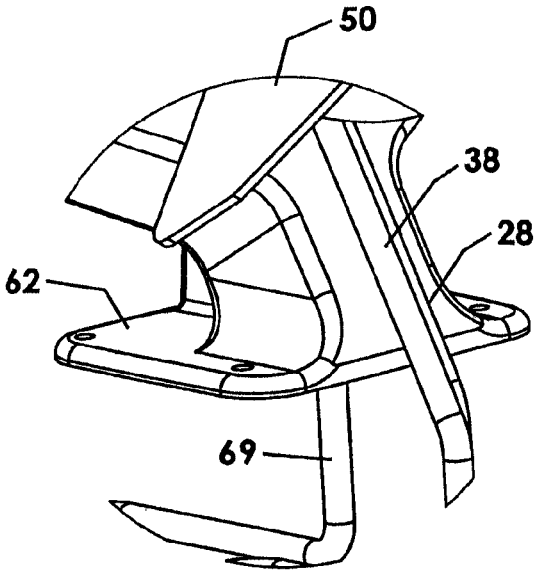
FIG. 3*d* is an isolated view on an enlarged scale taken from FIG. 3*a;*

The launching device 60 includes a framework 62 configured to receive and support the deployment capsule 42. The deployment capsule 42 is in fluid communication with a first compressed air canister 64 situated adjacent the framework 62 of the launching device 60 (FIGS. 3*a* and 3*b*). The first compressed air canister 64 is configured to deliver a burst of compressed air against the deployment capsule 42 so as to propel the deployment capsule 42 away from the framework 62 of the launching device 60.

Figure 2D:
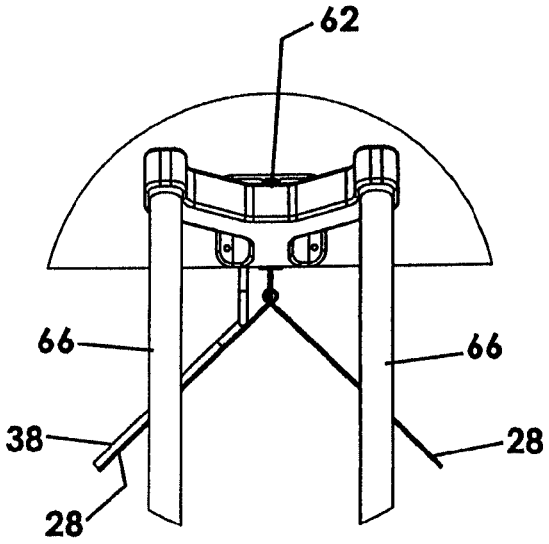
FIG. 2*d* is an isolated view on an enlarged scale taken from FIG. 2*a;*
Figure 4A:
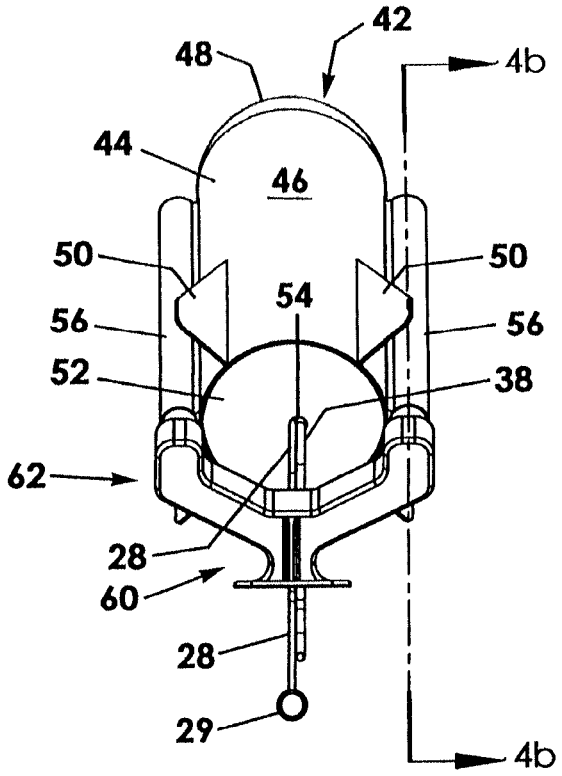
FIG. 4*a* is a rear perspective view of a deployment capsule in position on a launching device at an un-deployed configuration.
Figure 4B:
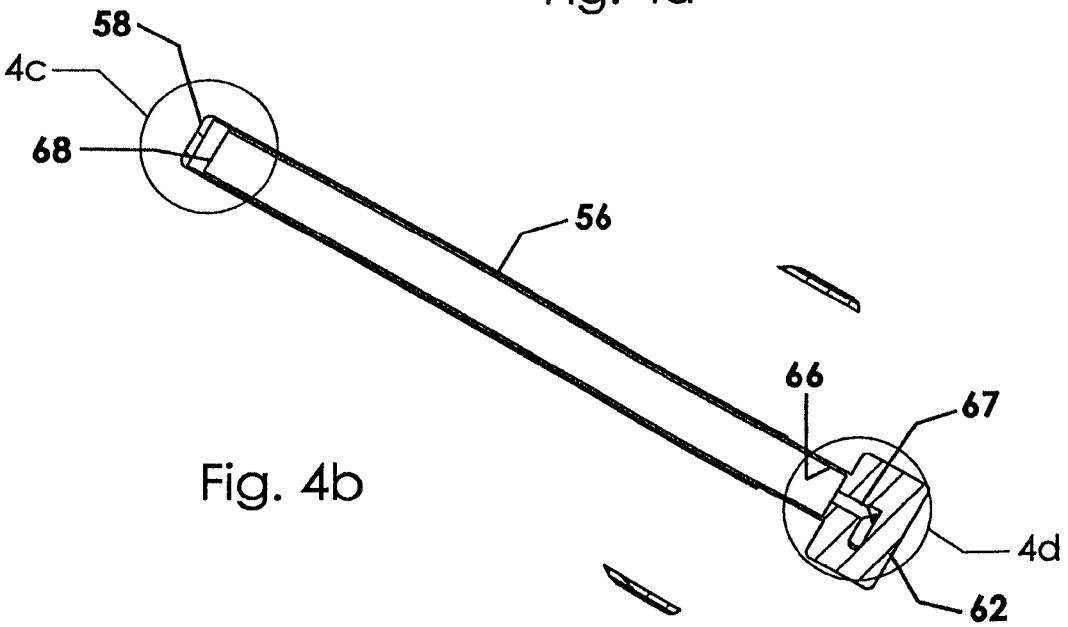
FIG. 4*b* is a sectional view taken along line 4*b*-4*b* of FIG. 4*a;*
Figure 4C:
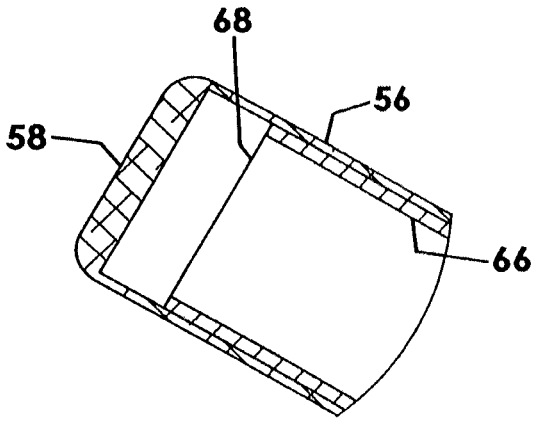
FIG. 4*c* is an isolated view on an enlarged scale taken from FIG. 4*b;*
Figure 4D:
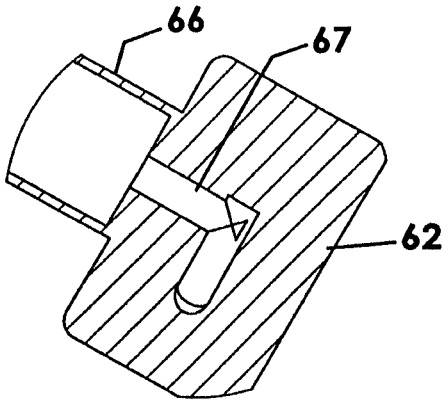
FIG. 4*d* is an isolated view on an enlarged scale taken from FIG. 4*b;*
Figure 5A:
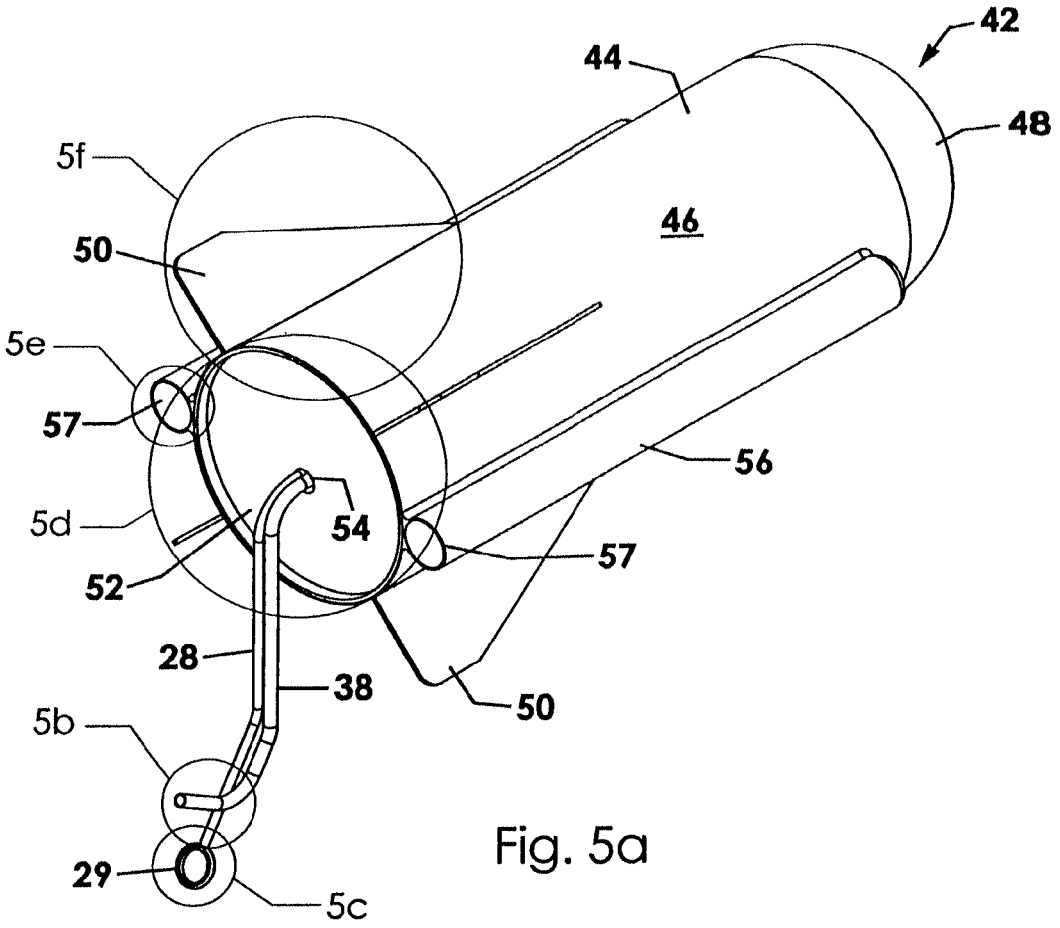
FIG. 5*a* is a perspective view of the deployment capsule removed from the launching device as in FIG. 4*a;*
Figure 5B:
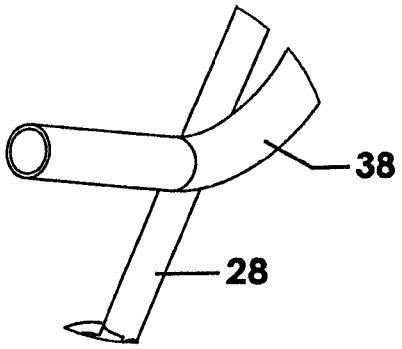
FIG. 5*b* is an isolated view on an enlarged scale taken from FIG. 5*a;*
Figure 5C:
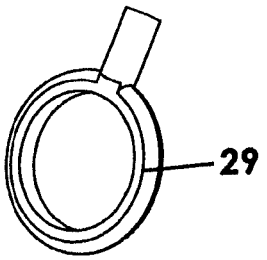
FIG. 5*c* is an isolated view on an enlarged scale taken from FIG. 5*a;*
Figure 5D:
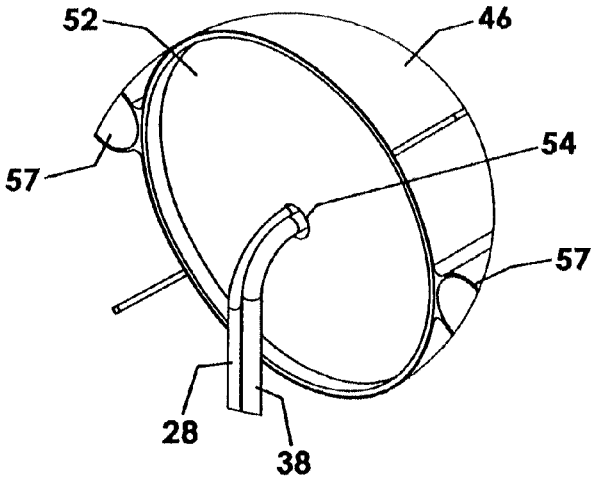
FIG. 5*d* is an isolated view on an enlarged scale taken from FIG. 5*a;*
Figure 5E:
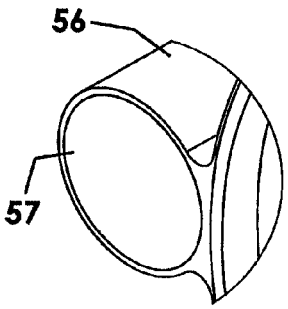
FIG. 5*e* is an isolated view on an enlarged scale taken from FIG. 5*a;*
Figure 5F:
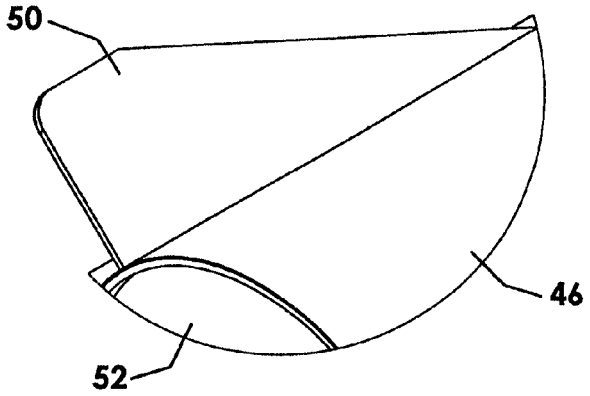
FIG. 5*f* is an isolated view on an enlarged scale taken from FIG. 5*a;*

More particularly, the launching device 60 includes a pair of launch rails 66 coupled to the framework 62 and extending outwardly therefrom (FIGS. 2*d* and 3*a*). The launch rails 66 are generally hollow or include channels extending therethrough. Distal ends 68 of the launch rails 66 have an open configuration (FIG. 4*c*). The framework 62 defines channels 67 through which compressed air from the first compressed air canister 64 flow into respective launch rails 66 (FIGS. 4*b* and 4*d*). The deployment capsule 42 includes a pair of launch tubes 56 coupled to opposed sides of the side wall 46 of the housing 44. Each launch tube 56 defines an open lower end 57 (FIG. 5*a*) and a closed upper end 58 (FIG. 4*c*) and defines a hollow interior area. Accordingly, the lower ends 57 of respective launch tubes are configured to receive respective distal ends 68 of respective launch rails 66 such that respective launch rails 66 are received into the interior area of respective launch tubes 56.

The first compressed air canister 64 is configured to deliver or push a burst of high pressure air through a hose or conduit 69 and into respective launch rails 66 when actuated. It is understood that the burst of high pressure air is sufficient to propel respective launch tubes 56 outwardly and away from the launch rails 66. Operatively, this action forcefully propels the entire deployment capsule 42 into the air and away from the launching device 60.

In another embodiment (not shown), the launching device 60 may include means other than compressed air to propel the deployment capsule 42 into the air, such as a chemical reaction that initiates a controlled explosion, in the manner of air bags or of firing of a bullet. In other words, chemical energy is turned into mechanical energy to initiate a controlled explosion sufficient to propel the launching device 60. Other means for propelling the deployment capsule 42 are also contemplated and considered equivalent to the air canister method described above.

The launching device 60 may be actuated manually to deploy the deployment capsule 42, such as with a launch switch situated on the launching device 60 (not shown) or on the first compressed air canister 64. Actuation may also be accomplished by remote control, either by a boat operator, an attendant, or even by the person having fallen overboard. In an embodiment, the rescue and retrieval system 10 may include a monitoring device 70 that may be worn or carried by every passenger on a boat and which can be used to either manually or automatically actuate the launching device.

Figure 6C:
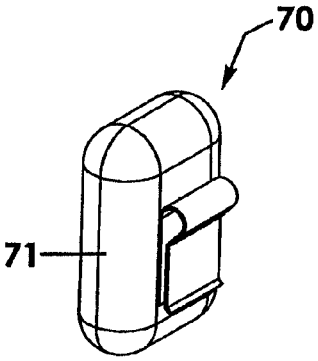
FIG. 6*c* is a perspective view of a monitoring device according to the present invention.
Figure 7:
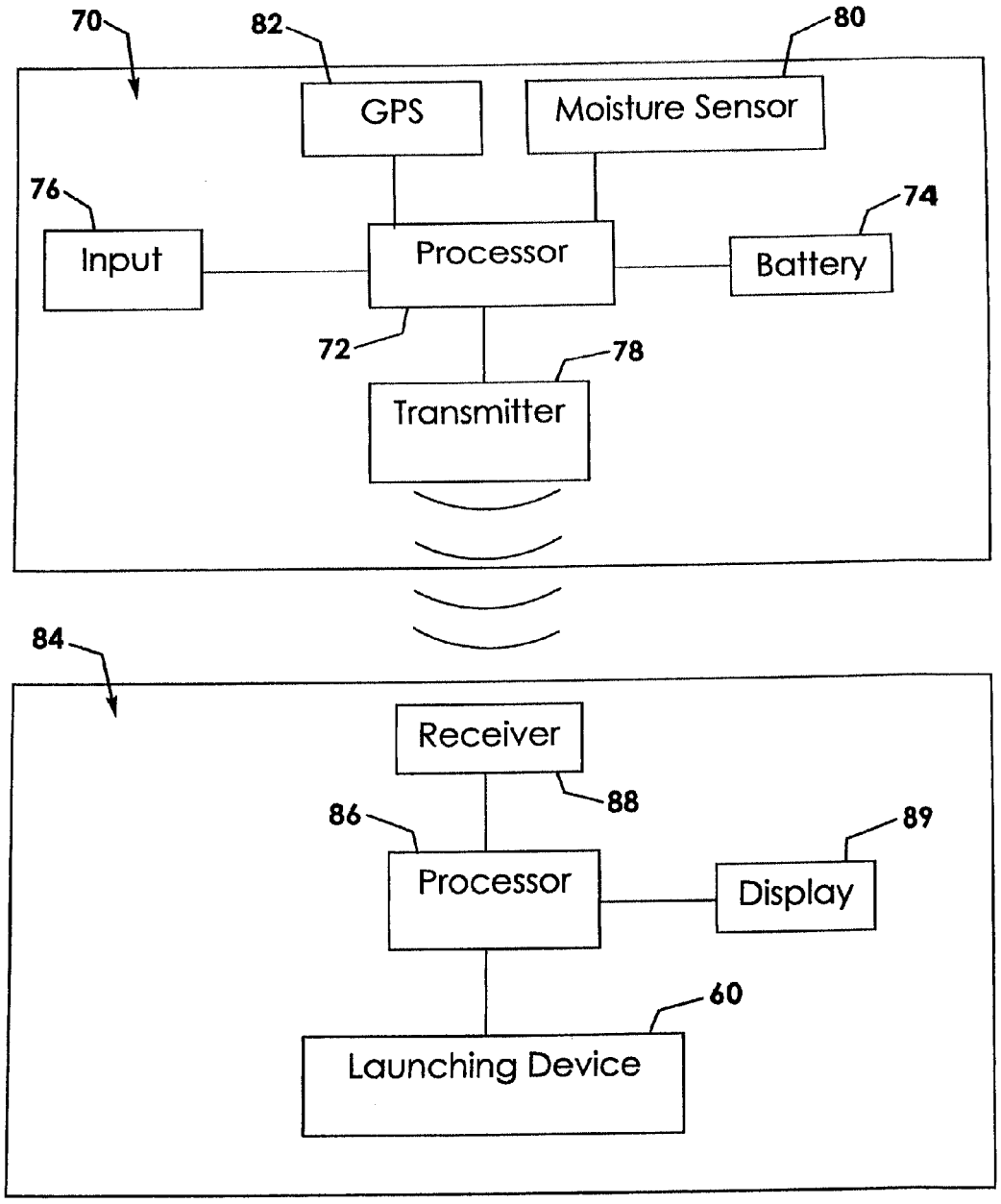
FIG. 7 is a block diagram illustrating a monitoring device and an emergency base station device.

More particularly, the monitoring device 70 may include a case 71 defining an interior area that is sealed and watertight and includes various electronic components (FIG. 6*c*). The monitoring device 70 may include a processor 72, a battery 74, a manual input 76, and a transmitter 78 (FIG. 7). It is understood that electrical circuitry may be utilized instead of a processor 72. If a processor 72 is utilized, it may execute programming instructions stored in a memory module (not shown) as is known in the art. In any case, the processor 72 is configured to actuate the transmitter 78 to send an emergency signal if the manual input 76 is manipulated. This corresponds to a person who has fallen overboard pressing the input button. In an embodiment, the monitoring device 70 may also include a moisture sensor 80 configured to detect if the monitoring device 70 has been submerged in water—which would be indicative of a person having fallen overboard. The processor 72 is configured to actuate the transmitter 78 to send an emergency signal if the moisture sensor 80 detects the aforesaid condition.

In an embodiment, the monitoring device 70 may also include a global positioning satellite module 82 configured to determine precise geographic coordinates of the monitoring device 70. The processor 72 may be configured to activate the transmitter 78 to send the most recent geographic coordinates with the emergency signal, whether the signal was sent manually or by activation of the moisture sensor 80.

The monitoring device 70 may include an emergency base device 84 having a processor 86, a receiver 88, and powered by a battery 87. The receiver 88 is configured to receive an emergency signal indicative that a person has fallen overboard and needs to be rescued. The processor 86 may be in electrical communication with the launching device 60 and configured to actuate deployment immediately upon receiving the emergency signal. In an embodiment where GPS coordinates are included with the emergency signal, the emergency base device 84 may include a display 89 that publishes the coordinates so that an attendant can adjust the position of the launching device 60 before actuating deployment of the deployment capsule 42 as described above. In another embodiment, structures may be included whereby the position of the launching device 60 is automatically adjusted based on the geographic coordinates and then the launching device 60 is actuated for deployment.

Figure 6D:
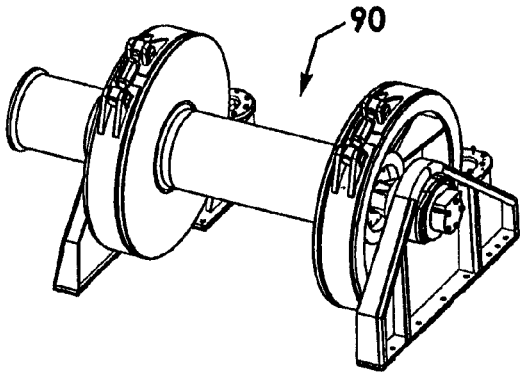
FIG. 6*d* is a perspective view of a winch assembly according to the present invention.

The person-in-the-water rescue and retrieval system 10 may include a winch assembly 90 for retrieving the net assembly 20 after it has been deployed onto the water (FIG. 6*d*). The winch assembly 90 may include a spool that is rotatably coupled to a base and configured to receive the net assembly 20 as the spool is rotated. Preferably, the winch assembly is electrically powered in that the net assembly 20 may be heavy when wet. It is understood that the plurality of net spreader members 34 should be in the deflated configuration when reeling in the net assembly 20.

In use, the person-in-the-water rescue and retrieval system 10 may be used in conjunction with a boat 12, on a beach, or any other location where rescuing one or more persons in peril of drowning is a risk. The launching device 60 may be mounted to the deck of a boat 12 and the net assembly 20 may be prepackaged inside the deployment capsule 42. The launch tubes 56 of the deployment capsule 42 may be received onto the launch rails 66 of the launching device 60 such that the net assembly 20 is ready to be deployed when actuated. If a person on the boat falls overboard, the first compressed air canister 64 may be manually actuated and, in doing so, a burst of high pressure air is delivered into the launch rails 66 so as to propel the deployment capsule 42 into the air as described above. As the deployment capsule 42 travels away from the launching device 60, the end cap 52 is dislodged and the net assembly 20 is pulled out of the interior area of the deployment capsule 42. When the net assembly 20 hits the water, the net spreader members 34 are inflated by operation of the second compressed air canister 36 so as to spread apart the side ropes 22 and keep the net portions 30 from bunching or tangling. Once deployed and inflated, the opportunity to rescue a person-overboard is enhanced.

In an embodiment, the deployment member 40 may be a weight or projectile operatively coupled to the net assembly 20. In the detailed discussion below, the deployment member according to this embodiment will be identified with reference numeral 40' and will be described with reference to FIGS. 8*a* to 14. Another embodiment of a launching device 60' and deployment member 40' is similar to the embodiment first described above except as specifically described below.

A launching device 60' according to an alternative embodiment includes a handheld framework 100 and a housing 102 coupled to the handheld framework 100, the housing 102 being configured to contain the net assembly 20 described above. The housing 102 may be coupled to the handheld framework 100 adjacent a distal end thereof. Similar to that described earlier, the housing 102 may include a single side wall arranged in a generally cylindrical configuration that defines an interior area sufficiently large enough to receive the net assembly 20. The housing 102 also defines an open front end 104 selectively covered by a pivotally attached cover 105.

In an embodiment, a reel 106 may be rotatably mounted in the open area of the housing 102 and configured to receive the netting wrapped thereabout. The reel 106 is configured to rotatably deploy the net assembly as it is pulled from the open front end 104 of the housing 102 when the deployment member 40' is actuated as will be described in more detail below.

Figure 8A:
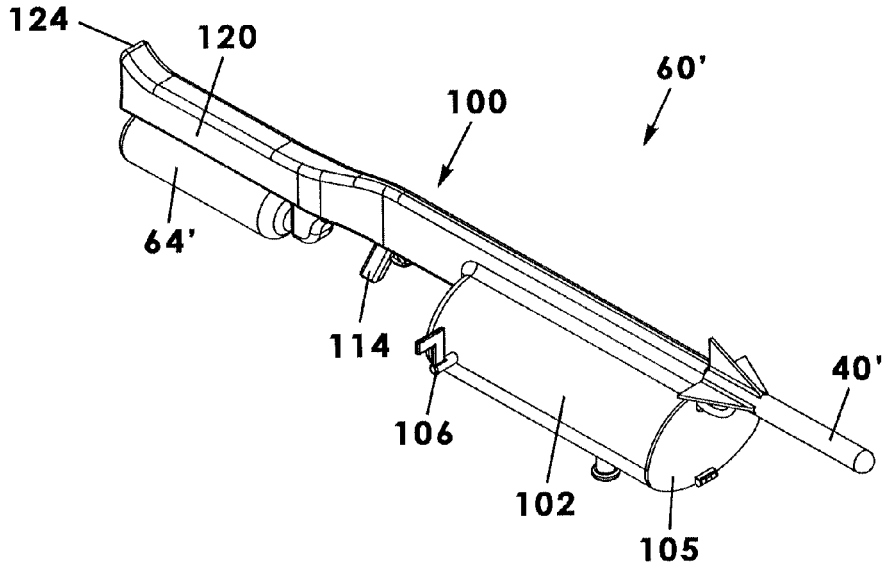
FIG. 8*a* is a perspective view of a launching device and deployment member according to another embodiment of the present invention.
Figure 8B:
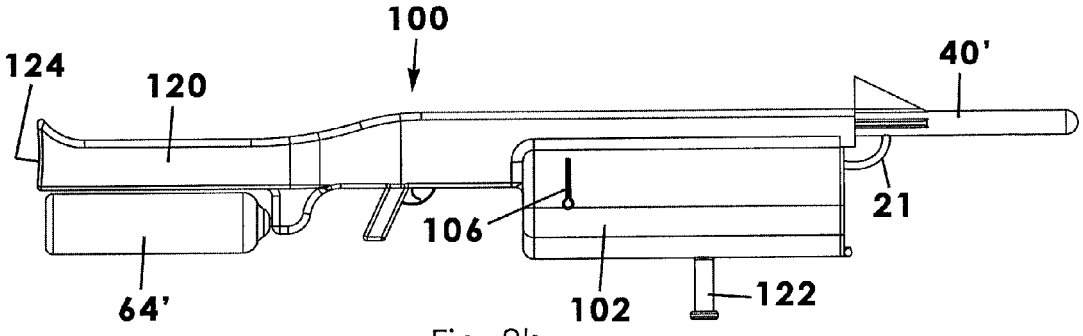
FIG. 8*b* is a side view of the launching device as in FIG. 8*a;*
Figure 9:
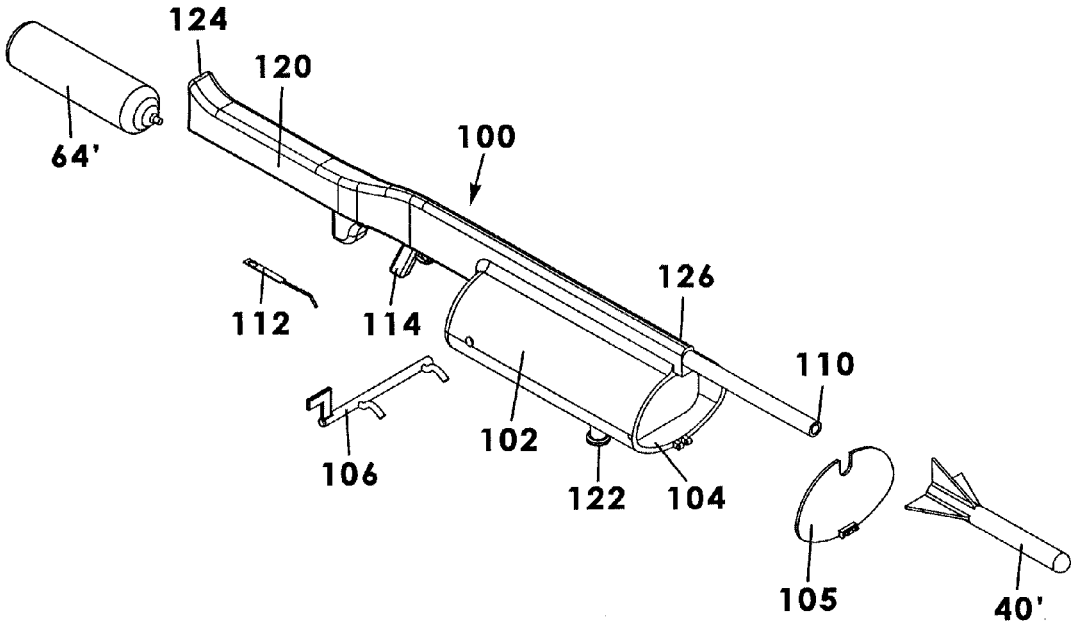
FIG. 9 is an exploded view of the launching device as in FIG. 8*a;*

As shown in FIG. 8*a*, the handheld framework 100 may be in the form of a rifle or other long barreled firearm. Preferably, the handheld framework 100 includes a stock 120 at a proximal end 124, the stock 120 having a shape configuration suitable for being held against a shoulder of a user such that the handheld framework 100 may be operated in the manner of a gun. Further, the handheld framework 100 may include a hand support 122 or handle adjacent the housing 102 and having an ergonomic configuration that enables a user to grasp it and hold the entire launching device 60' in the manner of shooting a gun. Other embodiments of launching devices are contemplated in which the framework may be in the form of a crossbow, catapult, slingshot, rocket propelled launcher, or the like (not shown).

The deployment member 40' in the form of a weighted projectile may be initially received and positioned on the distal end 126 of the handheld framework 100. The deployment member 40' is releasably coupled to the distal end 126 such that it is propelled away from the handheld framework 100.

Figure 10A:
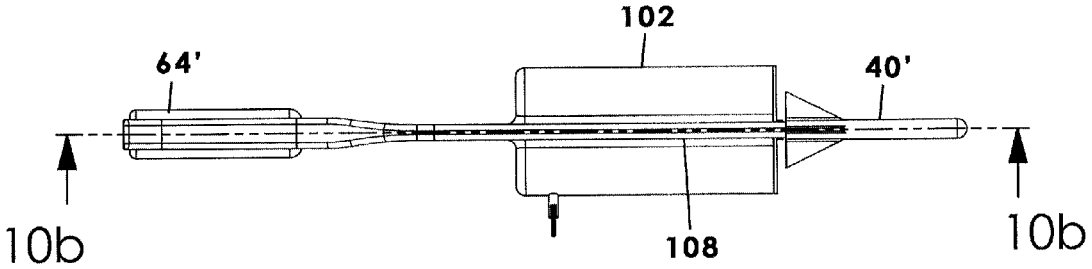
FIG. 10*a* is a top view of the launching device as in FIG. 8*b;*
Figure 10B:
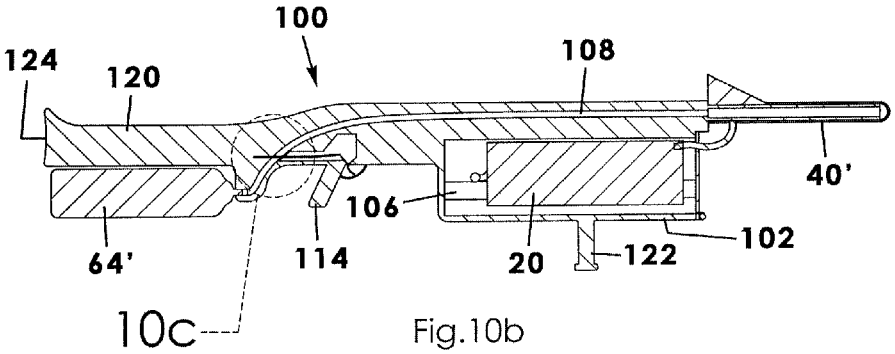
FIG. 10*b* is a sectional view taken along line 10*b*-10*b* of FIG. 10*a;*
Figure 10C:
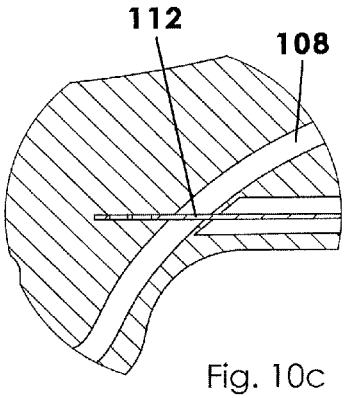
FIG. 10*c* is an isolated view on an enlarged scale taken from FIG. 10*b* illustrating an actuation valve in a closed configuration.
Figure 11A:
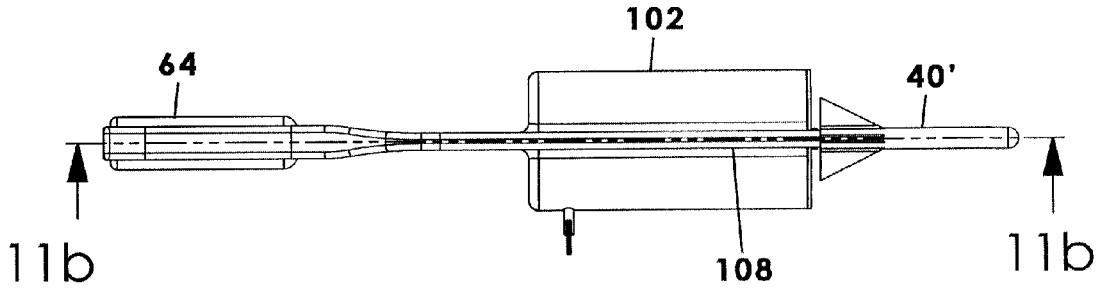
FIG. 11*a* is another a top view of the launching device as in FIG. 8*b;*
Figure 11B:
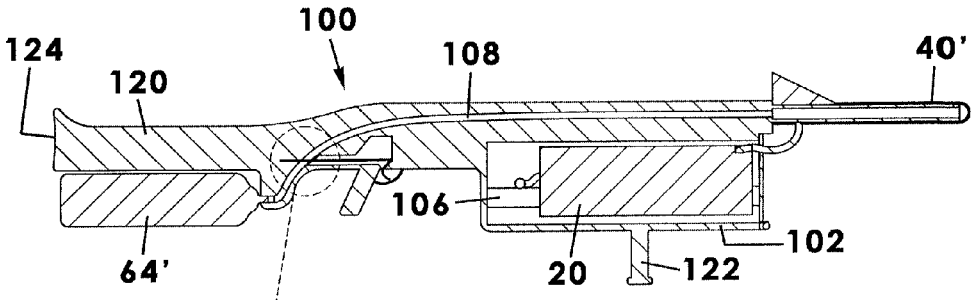
FIG. 11*b* is a sectional view taken along line 11*b*-11*b* of FIG. 11*a;*
Figure 11C:
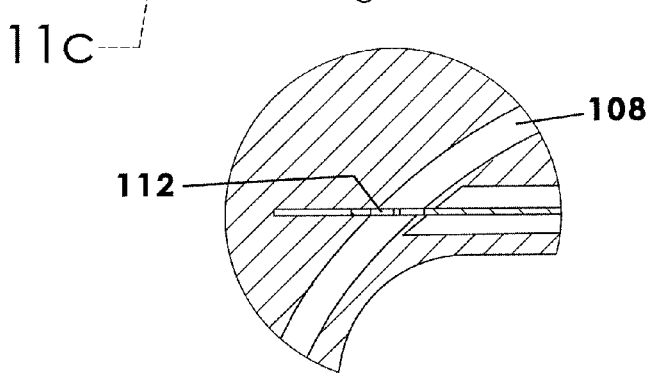
FIG. 11*c* is an isolated view on an enlarged scale taken from FIG. 11*b* illustrating an actuation valve in an open configuration.
Figure 12A:
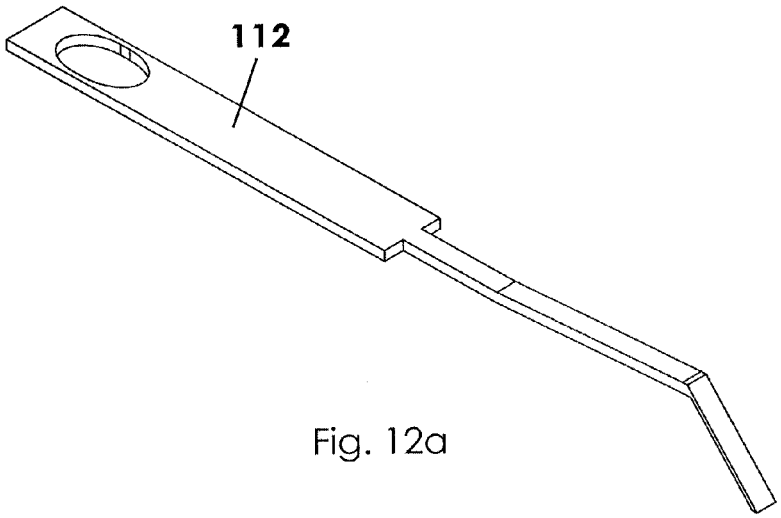
FIG. 12*a* is an isolated perspective view of the actuation valve removed from the actuation assembly as in FIG. 9.
Figure 12B:
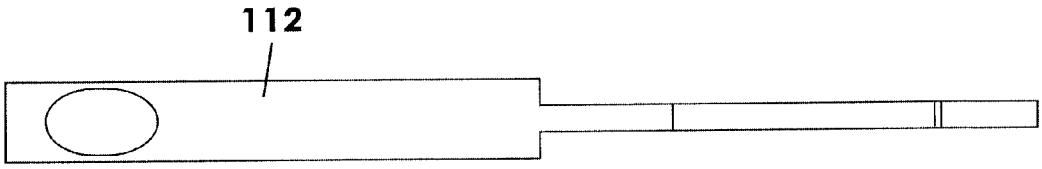
FIG. 12*b* is a top view of the actuation valve as in FIG. 12*a;*
Figure 13:
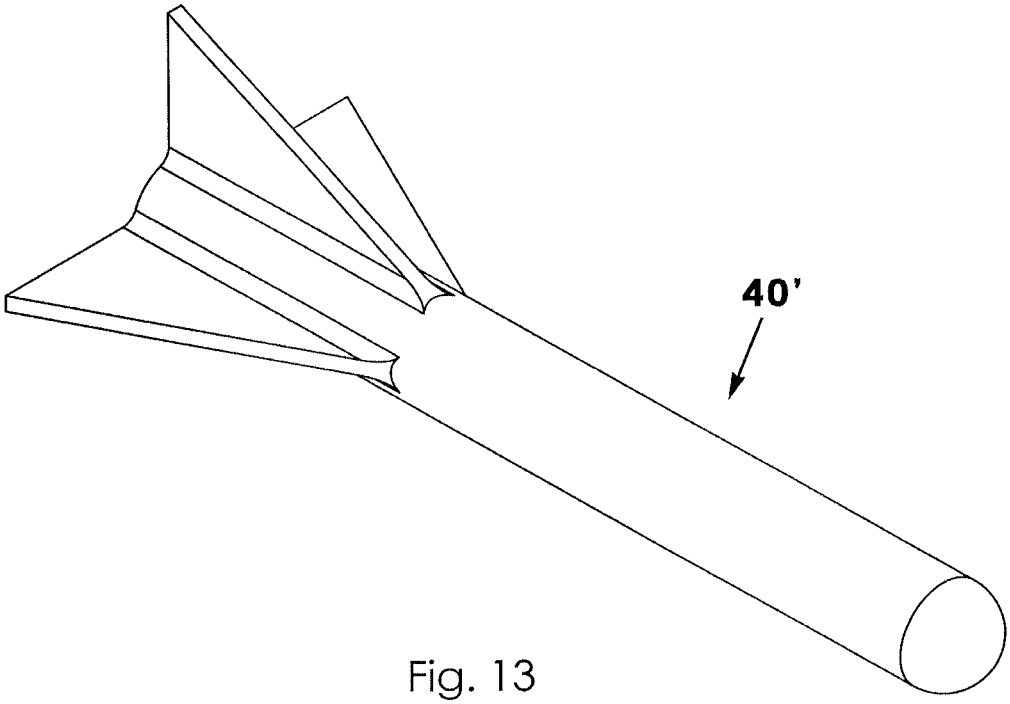
FIG. 13 is a perspective view of a weighted projectile as in FIG. 9.
Figure 14:
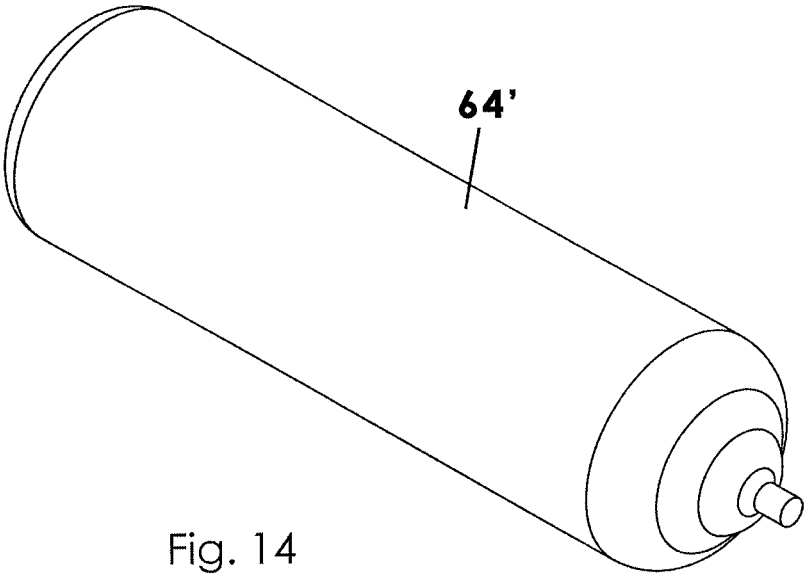
FIG. 14 is a perspective view of the propellant canister as in FIG. 9.

The deployment member 40' is actuated by fluid released from a propellant canister 64' that may be coupled to the stock 120 of the handheld framework 100 (FIG. 8*a*). As described previously, the propellant canister 64' may include compressed air, $CO_2$ gas, or even a chemical combination that creates an explosive reaction when combined. The projectile may a javelin, a rocket, a drone, or the like. The projectile would be operatively coupled to the net assembly 20 with a cord 21 (FIG. 10*b*).

The handheld framework 100 defines or includes a fluid conduit 108 connecting the propellant canister 64' with the deployment member 40'. Specifically, the fluid conduit 108 has an outlet end 110 adjacent the distal end of the handheld framework 100 and is configured to receive the deployment member 40' thereon until actuated (FIGS. 9*a* to 10*c*). An actuation valve 112 is positioned in the fluid conduit 108 proximate the propellant canister 64'. The actuation valve 112 is operable and movable between a closed configuration (FIGS. 10*b* and 10*c*) that prevents delivery of propellant from the propellant canister 64' to flow downstream in the fluid conduit 108 and an open configuration (FIGS. 9*b* and 9*c*) that allows delivery of propellant from the propellant canister 64' to flow downstream in the fluid conduit 108. A trigger 114 operatively coupled to the handheld framework 100 and operatively coupled to the actuation valve 112 so as to move it as described above.

It is understood that the earlier disclosure of a monitoring device 70 applies in the same manner to the handheld framework embodiment. Specifically, the monitoring device 70 may include a moisture sensor 80, a GPS component 82, and alert functions to enhance the efficacy of the person-in-the-water rescue and retrieval system 10 (FIG. 7).

In use, the launching device 60' having a handheld framework 100 (such as in the form of a rifle) will enable smaller watercraft to be outfitted with the present invention. The handheld framework 100 can be quickly picked up and aimed rearwardly of a boat from which a boater has fallen overboard and the net assembly 20 may be deployed with the quick pull of a trigger. Further, the launching device 60' may be easily positioned and operated from a dock, the shore, a bridge, or other location where a person could potentially be in danger of drowning after being swept away or otherwise dropped into a body of water.

When the trigger 114 is actuated, fluid from the canister 64' is delivered so as to launch the deployment member 40', the deployment member 40' being coupled to the net assembly 20 in the housing 102 so as to pull the net assembly 20 therefrom and deploy it over a body of water. A person over board may be rescued thereby as first described above.

It is understood that while certain forms of this invention have been illustrated and described, it is not limited thereto except insofar as such limitations are included in the following claims and allowable functional equivalents thereof.

The invention claimed is:

1. A person-in-the-water rescue and retrieval system, comprising:

a net assembly including:

a pair of laterally spaced apart side ropes;

a plurality of net portions coupled to said pair of side ropes, each net portion extending laterally between said pair of side ropes and being longitudinally spaced apart from an adjacent net portion;

a launching device having a handheld framework and a housing coupled to said handheld framework that is configured to receive said net assembly;

a deployment member operatively coupled to said pair of side ropes of said net assembly and releasably coupled to a distal end of said handheld framework;

a first propellant canister coupled to said handheld framework and in fluid communication with said deployment member, said first propellant canister configured to apply force to said deployment member when actuated that is sufficient to propel said deployment member from said launching device, whereby to spread said net assembly away from said handheld framework;

wherein:

each side rope has first and second ends and an elongate configuration;

each net portion includes netting arranged in a lattice configuration; and said net assembly defines a void between adjacent net portions;

wherein each said void defines a geometric area that is larger than a geometric area of an adjacent net portion.

2. The person-in-the-water rescue and retrieval system as in claim 1, wherein said launching device includes a fluid conduit extending between said propellant canister and said distal end of said handheld framework that is configured to deliver a predetermined volume of propellant from said propellant canister to said deployment member on demand.

3. The person-in-the-water rescue and retrieval system as in claim 2, further comprising an actuation assembly including:

a trigger;

an actuation valve positioned in said fluid conduit proximate connection of said fluid conduit to said propellant canister;

wherein said actuation valve is movable via operation of said trigger between a closed configuration not allowing delivery of propellant from said propellant canister to flow downstream in said fluid conduit and an open configuration allowing delivery of propellant from said propellant canister to flow downstream in said fluid conduit.

4. The person-in-the-water rescue and retrieval system as in claim 1, wherein:

said housing defines an interior space configured to receive said net assembly therein;

said launching device is configured to receive said deployment member adjacent said housing; and said propellant canister is configured to deliver explosive force to said deployment member when actuated that is sufficient to forcefully displace said deployment member away from said handheld framework, whereby to transport said net assembly away from said launching device.

5. The person-in-the-water rescue and retrieval system as in claim 1, wherein said housing includes an end cap configured to release said net assembly from said interior space when said deployment member is deployed from said launching device.

6. The person-in-the-water rescue and retrieval system as in claim 1, wherein said handheld framework of said launching device includes a stock adjacent an end of said launching device having a shape configuration adapted to be held against the shoulder of a user, said propellant canister being coupled to said stock.

7. The person-in-the-water rescue and retrieval system as in claim 1, wherein said handheld framework of said launching device includes a hand support member adjacent said housing and said distal end of said handheld framework.

8. The person-in-the-water rescue and retrieval system as in claim 1, comprising a winch assembly having a spool configured to receive said net assembly thereabout when actuated.

9. A person-in-the-water rescue and retrieval system, comprising:

a net assembly including:

a pair of laterally spaced apart side ropes;

a plurality of net portions coupled to said pair of side ropes, each net portion extending laterally between said pair of side ropes and being longitudinally spaced apart from an adjacent net portion;

a launching device having a handheld framework and a housing coupled to said handheld framework that is configured to receive said net assembly;

a deployment member operatively coupled to said pair of side ropes of said net assembly and releasably coupled to a distal end of said handheld framework;

a first propellant canister coupled to said handheld framework and in fluid communication with said deployment member, said first propellant canister configured to apply force to said deployment member when actuated that is sufficient to propel said deployment member from said launching device, whereby to spread said net assembly away from said handheld framework;

wherein said deployment member is a weighted projectile releasably coupled to said distal end of said handheld framework until launched upon actuation of said propellant canister, said netting assembly being forcefully pulled from said interior space of said housing when said deployment member is launched;

wherein said launching device includes a reel rotatably mounted in the interior space of said housing for receiving said net assembly thereabout, said reel configured to selectively retract and deploy said netting.

10. A person-in-the-water rescue and retrieval system, comprising:

a net assembly including:

a pair of laterally spaced apart side ropes;

a plurality of net portions coupled to said pair of side ropes, each net portion extending laterally between said pair of side ropes and being longitudinally spaced apart from an adjacent net portion;

a launching device having a handheld framework and a housing coupled to said handheld framework that is configured to receive said net assembly;

a deployment member operatively coupled to said pair of side ropes of said net assembly and releasably coupled to a distal end of said handheld framework;

a first propellant canister coupled to said handheld framework and in fluid communication with said deployment member, said first propellant canister configured to apply force to said deployment member when actuated that is sufficient to propel said deployment member from said launching device, whereby to spread said net assembly away from said handheld framework;

a monitoring device having a transmitter and an input, said input configured to actuate said transmitter to send an emergency signal into the air; and an emergency base device operatively coupled to said launching device, said emergency base device having a receiver configured to receive said emergency signal.

11. The person-in-the-water rescue and retrieval system as in claim 10, wherein said monitoring device includes a moisture sensor electrically connected to said transmitter and configured to detect a submersion in water condition, said moisture sensor configured to actuate said transmitter to send said emergency signal when said water condition is detected.

12. The person-in-the-water rescue and retrieval system as in claim 10, wherein said monitoring device includes a global positioning system ("GPS") module electrically connected to said transmitter and configured to determine geographic coordinates, said GPS module configured to actuate said transmitter to send said geographic coordinates with said emergency signal.

* * * * *